US007717790B2

(12) United States Patent
Shimizu

(10) Patent No.: US 7,717,790 B2
(45) Date of Patent: May 18, 2010

(54) SYMBOL DISPLAY DEVICE FOR GAME MACHINE

(75) Inventor: Toshiaki Shimizu, Yamato (JP)

(73) Assignee: Konami Gaming, Inc., Las Vegas, NV (US)

( * ) Notice: Subject to any disclaimer, the term of this patent is extended or adjusted under 35 U.S.C. 154(b) by 778 days.

(21) Appl. No.: 11/503,957

(22) Filed: Aug. 15, 2006

(65) Prior Publication Data

US 2008/0096652 A1 Apr. 24, 2008

(51) Int. Cl.
*A63F 9/24* (2006.01)

(52) U.S. Cl. ..... 463/31; 463/32; 463/33; 463/46; 273/141 R; 273/142 H; 273/143 R

(58) Field of Classification Search ..... 463/20, 463/31, 32, 33, 38, 46; 273/141 R, 142 H, 273/142, 143, 143 R
See application file for complete search history.

(56) References Cited

U.S. PATENT DOCUMENTS 6,715,756 B2 4/2004 Inoue
6,893,018 B2 * 5/2005 Inoue ..... 273/143 R
2004/0000754 A1 * 1/2004 Inoue ..... 273/143 R
2007/0054727 A1 * 3/2007 Garamendi et al. ..... 463/16

* cited by examiner

*Primary Examiner*—Corbett Coburn
*Assistant Examiner*—Brandon Gray
(74) *Attorney, Agent, or Firm*—Sughrue Mion, PLLC

(57) ABSTRACT

A symbol display device for a game machine includes a reel unit having a plurality of reels, each having a peripheral surface with a plurality of peripheral symbols. An end reel arranged at an end position of the reels has a lateral surface where a pointer is displayed. A reel supporting member that supports the reels rotatably independently includes a lateral wall having a window through which the lateral surface of the end reel is seen. The lateral wall of the reel supporting member has a plurality of lateral symbols arranged around the window, whereby any one of the lateral symbols is pointed by the pointer on the lateral surface of the end reel due to rotation of the end reel. A pivoting unit pivots the reel unit to a first position where the peripheral surfaces of the reels are observable and to a second position where the pointer on the lateral surface of the end reel and the lateral symbols on the lateral wall of the reel supporting member are observable.

7 Claims, 7 Drawing Sheets

SYMBOL DISPLAY DEVICE FOR GAME MACHINE

BACKGROUND OF THE INVENTION

1. Field of the Invention

The present invention relates to a symbol display device for use in a game machine.

2. Prior Art

A game machine, such as a slot machine, includes a reel unit having a plurality of reels supported rotatably independently, each having the peripheral surface with a plurality of peripheral symbols. When the reels stop rotating, it is determined whether or not the combination of the symbols on the reels corresponds to any one of predetermined prize patterns.

U.S. Pat. No. 6,715,756 discloses another slot machine including a symbol display device in addition to usual reels. This symbol display device is arranged above the usual reels and has a single reel with a first display portion on its side surface and with a second display portion on its periphery. When a player wins the normal slot game using the usual reels, this special symbol display device enables players to play subsidiary games. In performing a first subsidiary game, the side surface of the special single reel is so perpendicular that the first display portion may be observable. In performing a second subsidiary game, the periphery of the special single reel is so horizontal that the second display portion may be observable.

However, such a special symbol display device arranged at a different position from the usual reels makes players shift their attention significantly. A careless player may lose sight of the special symbol display device and will not be able to enter the subsidiary games smoothly. A player with weak eyes cannot see the special symbol display device unless he or she stands up for playing the subsidiary games after the normal slot game.

SUMMARY OF THE INVENTION

The present invention provides a symbol display device having a plurality of reels for use in a game machine that can enable players to play a plurality sorts of games including a game using the plurality of reels without moving their eyes widely.

In accordance with the present invention, a symbol display device for a game machine comprises a reel unit and a pivoting unit that pivots the reel unit. The reel unit includes a plurality of reels each having a rotational axis and aligned in manner that the rotational axes are coincident or substantially parallel, each of the reels having a peripheral surface where a plurality of peripheral symbols are displayed, the reels including an end reel arranged at an end position of the reels, the end reel having a lateral surface where a pointer is displayed. The reel unit also includes a reel supporting member that supports the reels rotatably independently, the reel supporting member including a lateral wall having a window through which the lateral surface of the end reel is seen, the lateral wall having a plurality of lateral symbols arranged around the window, whereby any one of the lateral symbols is pointed by the pointer on the lateral surface of the end reel due to rotation of the end reel. The reel unit further includes a plurality of driving units that rotate the reels respectively. The pivoting unit pivots the reel unit to a first position where the peripheral surfaces of the reels are observable and to a second position where the pointer on the lateral surface of the end reel and the lateral symbols on the lateral wall of the reel supporting member are observable.

By virtue of the single reel unit according to the present invention, players can play a plurality sorts of games including a game using the plurality of reels without moving their eyes widely. When the pivoting unit pivots the reel unit to the first position, players can play a first game using the peripheral surfaces of the plurality of reels. When the pivoting unit pivots the reel unit to the second position, players can play a second game using the end reel having the rotatable pointer.

Preferably, the reel unit may include a second end reel arranged at a second end position of the reels opposite to the end reel, the second end reel having a second lateral surface where a second pointer is displayed. In this case, the reel supporting member may include a second lateral wall having a second window through which the second lateral surface of the second end reel is seen, the second lateral wall having a plurality of second lateral symbols arranged around the second window, whereby any one of the second lateral symbols is pointed by the second pointer on the second lateral surface of the second end reel due to rotation of the second end reel. The pivoting unit may further pivot the reel unit to a third position where the second pointer on the second lateral surface of the second end reel and the second lateral symbols on the second lateral wall of the reel supporting member are observable. When the pivoting unit pivots the reel unit to the third position, players can play a third game using the second end reel having the second rotatable pointer.

Preferably, the lateral symbols and/or the second lateral symbols are changeably displayed by electronic display devices.

In accordance another aspect of the present invention, a game machine comprises the above-described symbol display device.

BRIEF DISCRIPTION OF THE DRAWINGS

The present invention will be described with reference to various embodiments of the invention, with reference to the accompanying drawings, which illustrate a plurality of forms of the invention, described by way of example only. The various forms of the present invention are described by way of example only in the accompanying diagrammatic drawings in which.

DETAILED DESCRIPTION OF PREFERRED EMBODIMENTS OF THE INVENTION

Figure 1:
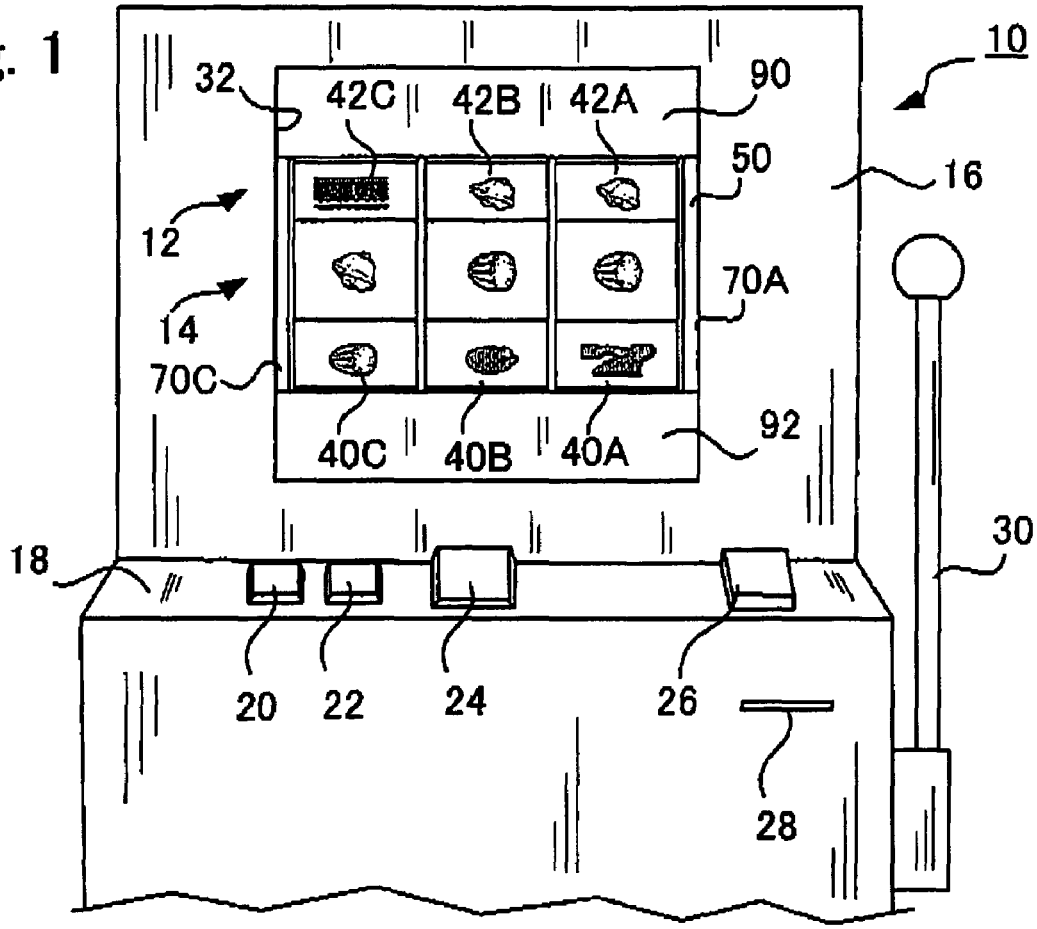
FIG. 1 is a front view of a game machine including a symbol display device according to a first embodiment of the present invention having a reel unit having been stopped at a first position.

As shown in FIG. 1, a game machine 10 according to a first embodiment of the present invention includes a symbol display device 12 that has a reel unit 14. In the state shown in FIG. 1, the reel unit 14 has been stopped at a first position that will be described in more detail later.

The game machine 10 in the embodiment is a slot machine, but may be another type of game machine. The game machine 10 comprises a housing 16 including a front stage 18 on which mounted are various buttons, e.g., a cash button 20, a bet button 22, a spin button 24, and a credit button 26. This game machine 10 is an automatic-stop type wherein each reel is automatically stopped, so that no stop buttons are provided. However, this game machine 10 may be a manual-stop type having stop buttons (not shown) that are pushed by players for stopping the reels of the reel unit 14, respectively The lower front panel of the housing 16 that is below the front stage 18 has a coin slot 28 into which coins are inserted. A spin lever 30 is rotatably mounted on the right side panel of the housing 16.

The symbol display device 12 is located inside the housing 16. An opening 32 is formed at the upper front panel of the housing that is located above the front stage 18, and a part of the symbol display device 12 can be seen through the opening 32.

Figure 2:
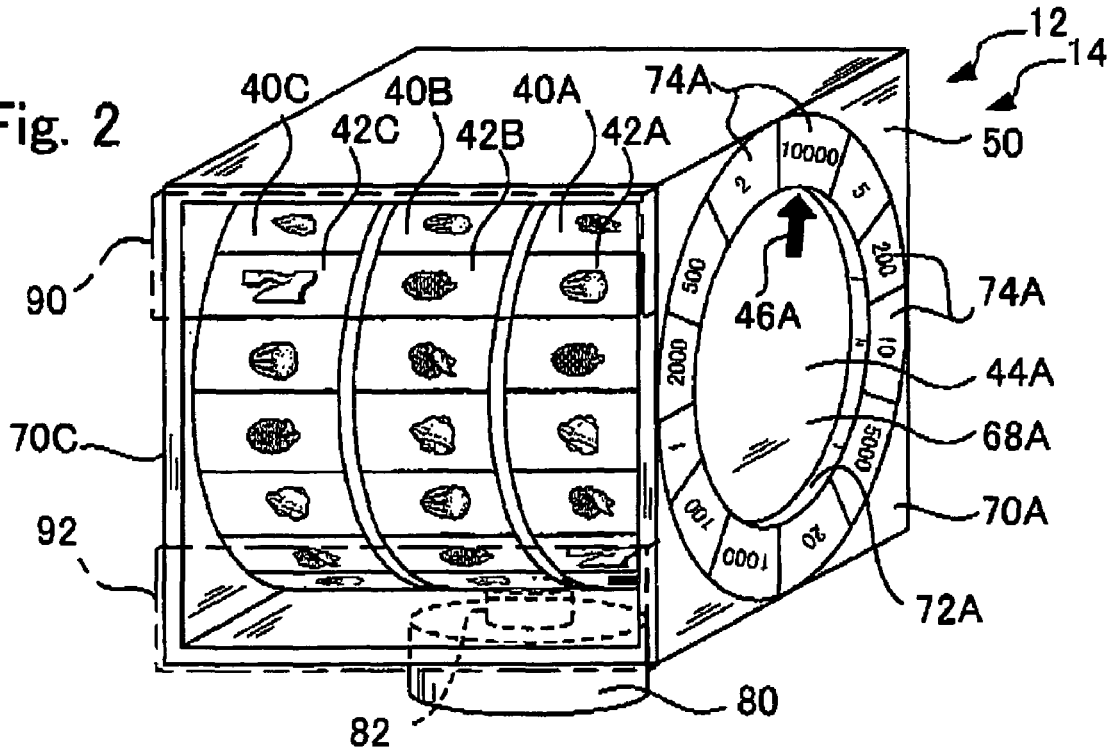
FIG. 2 is a perspective view of the symbol display device.
Figure 3:
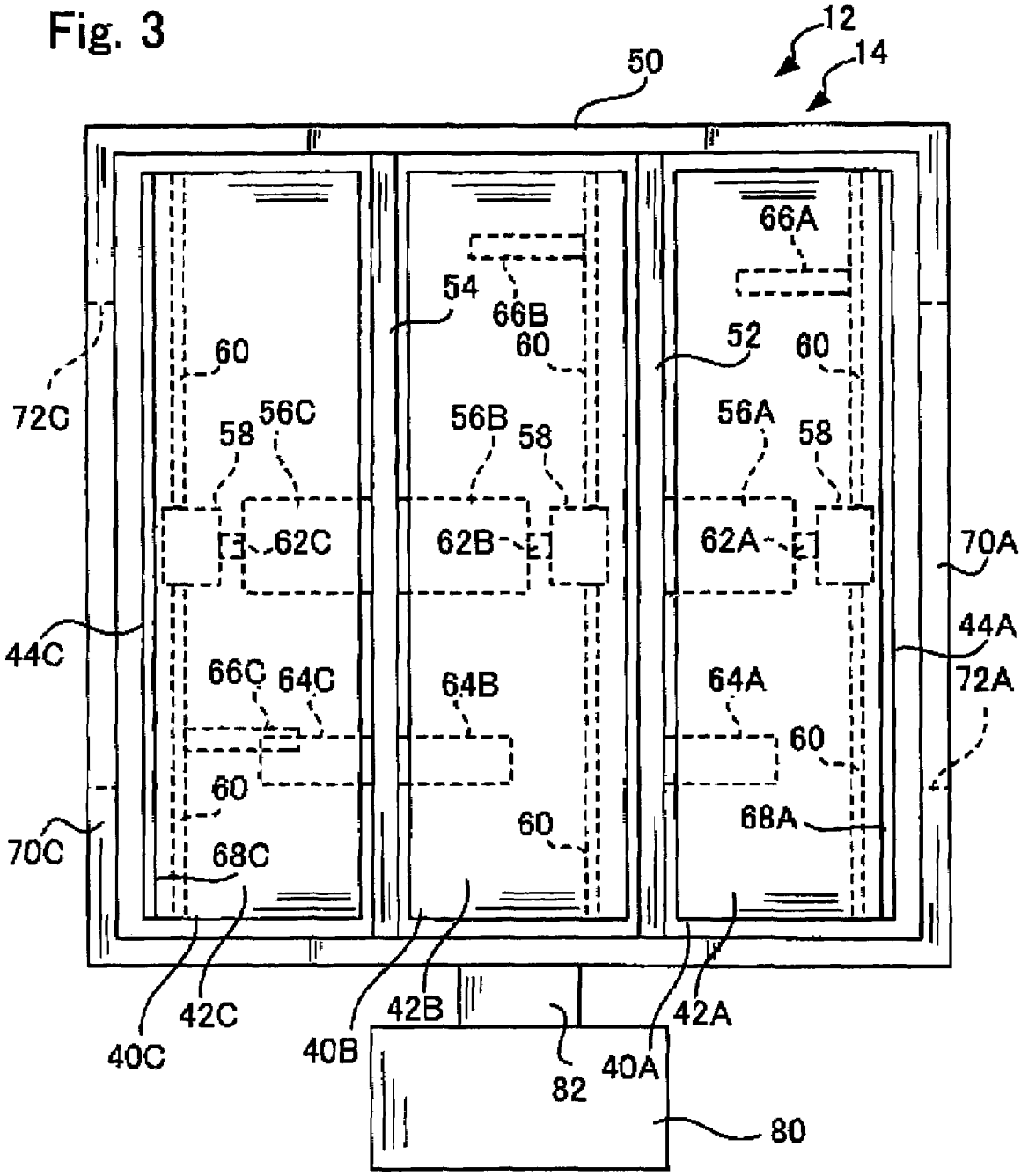
FIG. 3 is a front view of the symbol display device.

Details of the symbol display device 12 are shown in FIGS. 2 and 3. The symbol display device 12 comprises a reel unit 14. The reel unit 14 includes a plurality of (three) rotatable reels, namely, right-end reel 40A, center reel 40B, and left-end reel 40C each having a rotational axis and aligned in manner that the rotational axes are coincident with one another. In an alternative embodiment that is not shown, the rotational axes of the reels 40A, 40B, and 40C may be substantially parallel to one another. Preferably, the cylindrical reels 40A, 40B, and 40C are of the same size, but it is not intended to limit the present invention to the illustrated embodiment.

As shown in FIG. 2, each of the reels 40A, 40B, and 40C has a peripheral surface 42A, 42B, or 42C where a plurality of peripheral symbols are displayed as similar to reels in conventional slot machines. When the reels stop rotating, it is determined whether or not the combination of the symbols on the reels corresponds to any one of predetermined prize patterns.

The right-end reel (first end reel) 40A arranged at the right end position of the reels 40A, 40B, and 40C has a right lateral surface 44A where a first rotatable pointer 46A is displayed. The first rotatable pointer 46A is of an arrow shape and can be rotated due to rotation of the right-end reel 40A.

Figure 5:
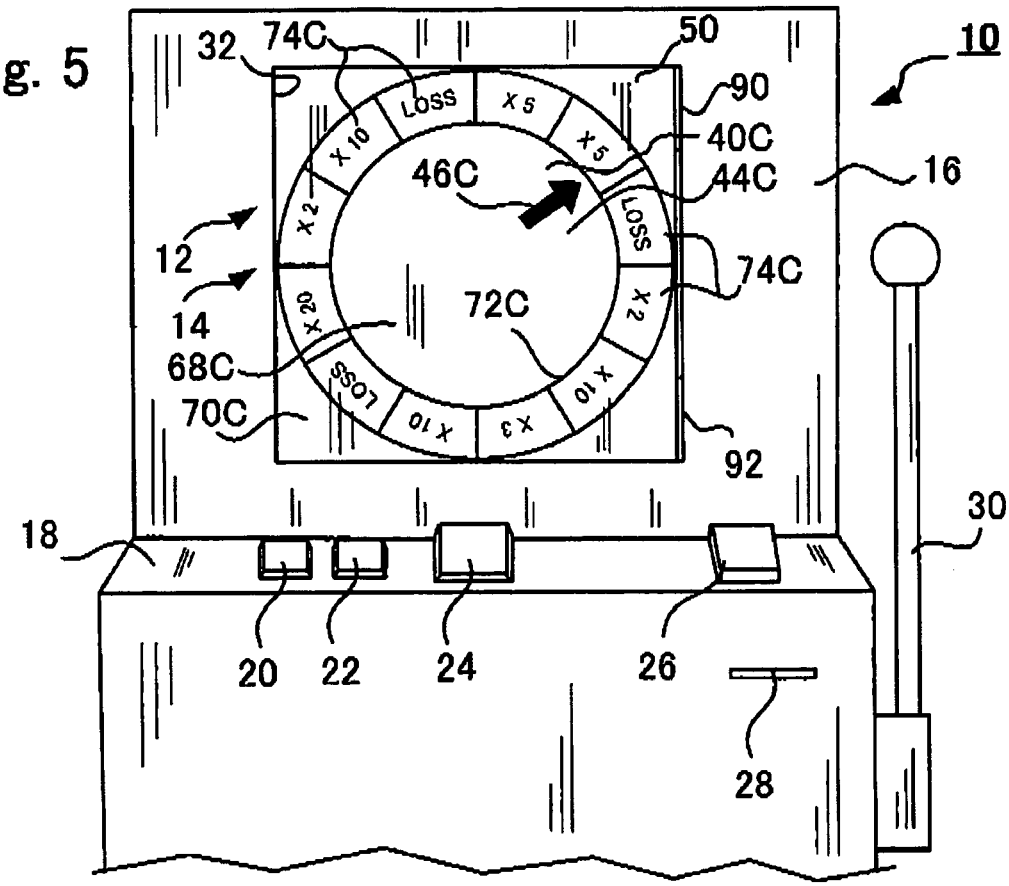
FIG. 5 is a front view of the game machine wherein the reel unit has been stopped at a third position.

On the other hand, the left-end reel (second end reel) 40C arranged at the left end position of the reels 40A, 40B, and 40C has a left lateral surface 44C where a second rotatable pointer 46C is displayed as best shown in FIG. 5. The second rotatable pointer 46C is also of an arrow shape and can be rotated due to rotation of the left-end reel 40C. The shape of the pointers 46A and 46C is not intended to be limited to the illustrated embodiment, and other shapes can be substituted.

As shown in FIGS. 2 and 3, the reel unit 14 also includes a reel supporting member or reel case 50 that supports the reels 40A, 40B, and 40C rotatably independently. Generally, the reel case 50 is of a hollow cubic shape having four square walls (top and bottom walls and right and left lateral walls) defining a cubic inner space within the reel case 50. As best shown in FIG. 3, two inner walls or supporting plates 52 and 54 that are arranged in parallel are located within the reel case 50. The supporting plates 52 and 54 are fixed to the top and bottom walls of the reel case 50.

The reel unit 14 further includes a plurality of driving units, namely, reel motors 56A, 56B, and 56C that rotate the reels 40A, 40B, and 40C, respectively. A right-end reel motor 56A is mounted on the right supporting plate 52 while a center reel motor 56B and a left-end reel motor 56C are mounted on the left supporting plate 54.

Generally, each of the reels 40A, 40B, and 40C is of a hollow cylindrical shape. In addition, each of the reels 40A, 40B, and 40C has a center hub 58 located at the center of the hollow cylindrical shape and a plurality of spokes 60 radially extending outwards from the hub 58. The outermost ends of the spokes 60 are fixed to the inner surface of the hollow cylindrical reels 40A, 40B, and 40C.

The right-end reel motor 56A has a rotational shaft 62A to which the hub 58 of the right-end reel 40A is fixed. The center reel motor 56B has a rotational shaft 62B to which the hub 58 of the center reel 40B is fixed. The left-end reel motor 56C has a rotational shaft 62C to which the hub 58 of the left-end reel 40C is fixed. Thus, the reel motors 56A, 56B, and 56C directly rotate the corresponding reels 40A, 40B, and 40C, independently.

Each of the reel motors 56A, 56B, and 56C is a type in which the rotational angle can be controlled and stopped precisely. For example, a stepping motor may be preferably used for the reel motors. Although the reel motors 56A, 56B, and 56C directly rotate the corresponding reels 40A, 40B, and 40C in the illustrated embodiment, a suitable transmission mechanism, e.g., a gear transmission mechanism, a belt-pulley transmission mechanism, or a chain-sprocket mechanism may be used for transmitting the individual movement of the driving unit to the corresponding reel in an alternative embodiment (not shown).

The reel unit 14 further includes a plurality of sensors, namely, reel sensors 64A, 64B, and 64C for estimating the rotational angle of the reels 40A, 40B, and 40C, respectively. Each of the reel sensors 64A, 64B, and 64C is, e.g., a photosensor or a proximity sensor. The right-end reel sensor 64A mounted on the right supporting plate 62 detects a segment 66A mounted on one of the spokes 60 of the right-end reel 40A when the segment 66A passes the right-end reel sensor 64A due to rotation of the right-end reel 40A. The center reel sensor 64B mounted on the left supporting plate 54 detects a segment 66B mounted on one of the spokes 60 of the center reel 40B when the segment 66B passes the center reel sensor 64B due to rotation of the center reel 40B. The left-end reel sensor 64C mounted on the left supporting plate 54 detects a segment 66C, mounted on one of the spokes 60 of the left-end reel 40C when the segment 66C passes the left-end reel sensor 64C due to rotation of the left-end reel 40C. The number of pulses input to the reel motor after the time of the last detection of the segment by the corresponding sensor is relevant to the rotational angle of the reel. Therefore, the control system (center processing unit) of the slot machine can estimate the rotational angle of each reel on the basis of the detection signal from the reel sensor.

A right lateral plate 68A with a circular shape is attached to the right-end reel 40A. The right lateral plate 68A has the right lateral surface 44A where the first rotatable pointer 46A is printed as best shown in FIG. 2. On the other hand, a left lateral plate 68C with a circular shape is attached to the left-end reel 40C. The left lateral plate 68C has the left lateral surface 44C where the second rotatable pointer 46C is printed as best shown in FIG. 5.

Figure 4:
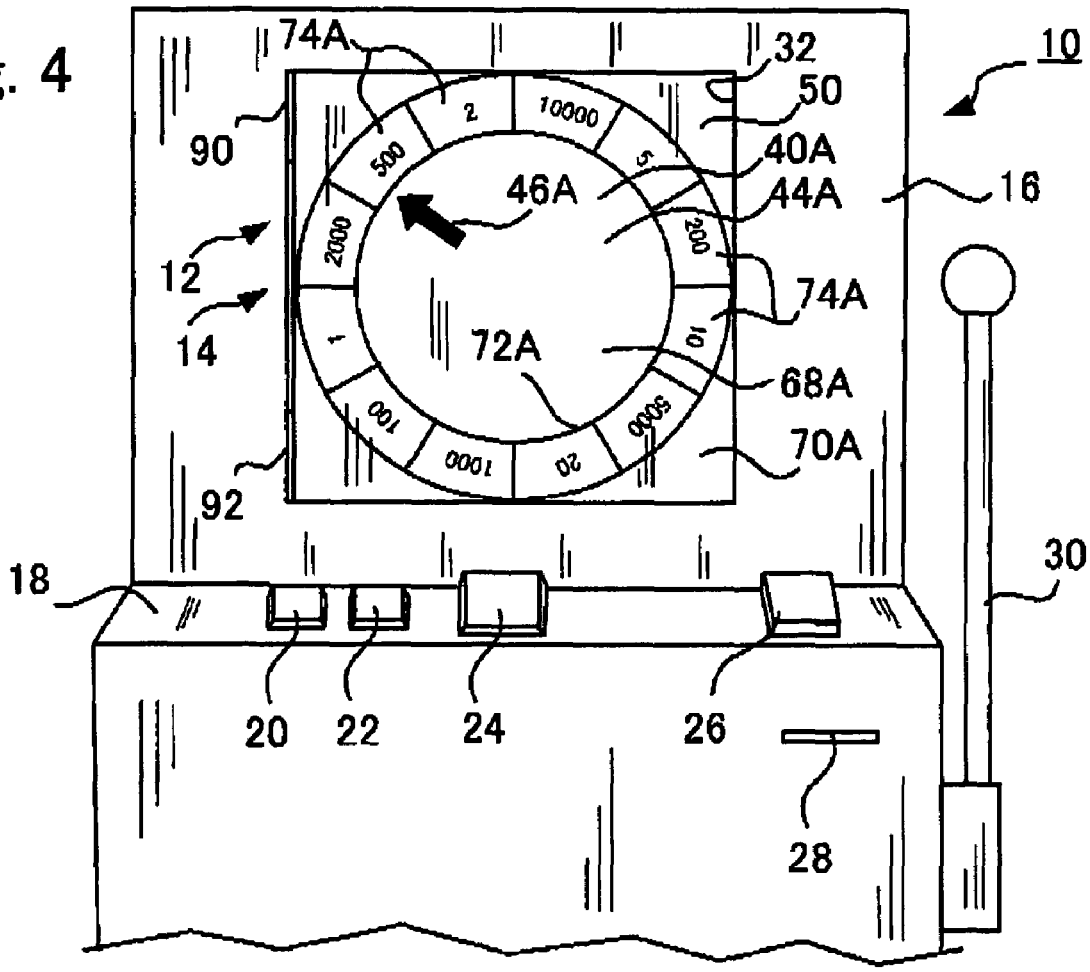
FIG. 4 is a front view of the game machine wherein the reel unit has been stopped at a second position.

As shown in FIGS. 2 through 4, the right lateral wall (first lateral wall) 70A of the reel case 50 has a first circular window 72A through which the right lateral surface 44A of the right-end reel 40A is seen. The right lateral wall 70A has a plurality of first lateral symbols 74A arranged around the first window 72A, whereby any one of the first lateral symbols 74A is pointed by the first rotatable pointer 46A on the right lateral surface 44A of the right-end reel 40A due to rotation of the right-end reel 40A.

As shown in FIGS. 3 and 5, the left lateral wall (second lateral wall) 70C of the reel case 50 has a second circular window 72C through which the left lateral surface 44C of the left-end reel 40C is seen. The left lateral wall 70C has a plurality of second lateral symbols 74C arranged around the second window 72C, whereby any one of the second lateral symbols 74C is pointed by the second rotatable pointer 46C on the left lateral surface 44C of the left-end reel 40C due to rotation of the left-end reel 40C.

As shown in FIGS. 2 and 3, the symbol display device 12 further includes a pivoting unit or reel unit motor 80 that pivots the reel unit 14 in a horizontal plane The reel unit motor 80 has a rotational shaft 82 to which the bottom wall of the reel case 50 is fixed. Thus, the reel unit motor 80 directly rotates the reel unit 14 as a whole.

The reel unit motor 80 is a type in which the rotational angle can be controlled and stopped precisely. For example, a stepping motor may be preferably used for the reel unit motor. Although the reel unit motor 80 directly rotates the reel case 50 in the illustrated embodiment, a suitable transmission mechanism, e.g., a gear transmission mechanism, a belt-pulley transmission mechanism, or a chain-sprocket mechanism may be used for transmitting the movement of the pivoting unit to the reel unit in an alternative embodiment (not shown).

The reel unit motor 80 pivots the reel unit 14 to a first position where the peripheral surfaces 42A, 42B, and 42C of the reels 40A, 40B, and 40C are observable through the opening 32 of the housing 16 as shown in FIG. 1. After the reel unit motor 80 pivots the reel unit 14 to the first position and stops the reel unit 14 at the first position, players can play a first game, i.e., a normal slot game using the peripheral surfaces 42A, 42B, and 42C of the plurality of reels 40A, 40B, and 40C.

An upper blindfold plate 90 and a lower blindfold plate 92 may be attached to the reel ease 50, so as to locate at the upper and lower parts of the front opening of the reel case 50. By virtue of the blindfold plates 90 and 92, players can see only a middle level part of the reel unit 14 as shown in FIG. 1 when the reel unit 14 is at the first position.

The reel unit motor 80 pivots the reel unit 14 to a second position that is different from the first position by 90 degrees. In the second position, the first rotatable pointer 46A on the right lateral surface 44A of the right-end reel 40A and the first lateral symbols 74A on the right lateral wall 70A of the reel case 50 are observable through the opening 32 of the housing 16 as shown in FIG. 4. After the reel unit motor 80 pivots the reel unit 14 to the second position and stops the reel unit 14 at the second position, players can play a second game using the right-end reel 40A having the first rotatable pointer 46A.

The reel unit motor 80 further pivots the reel unit 14 to a third position that is different from the second position by 180 degrees. In the third position, the second rotatable pointer 46C on the left lateral surface 44C of the left-end reel 40C and the second lateral symbols 74C on the left lateral wall 70C of the reel case 50 are observable through the opening 32 of the housing 16 as shown in FIG. 5. After the reel unit motor 80 pivots the reel unit 14 to the third position and stops the reel unit 14 at the third position, players can play a third game using the left-end reel 40C having the second rotatable pointer.

By virtue of the single reel unit 14 according to the first embodiment of the present invention, players can play a plurality sorts of games including a game using the plurality of reels 40A, 40B, and 40C without moving their eyes widely.

Figure 6:
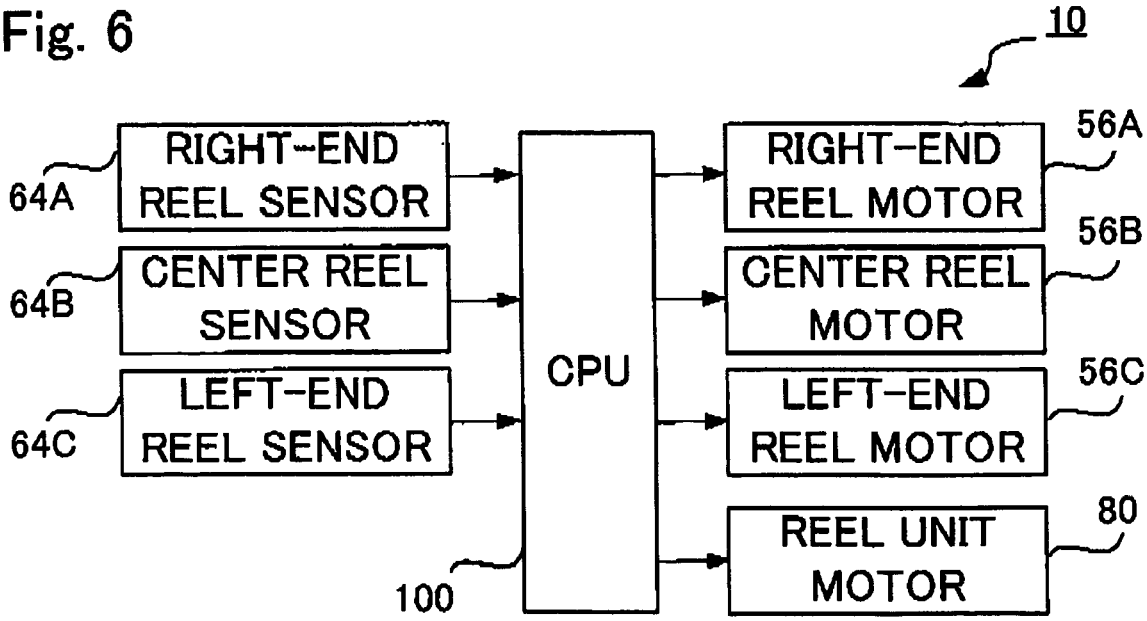
FIG. 6 is a block diagram of the game machine.

As shown in FIG. 6, the game machine 10 includes a center processing unit (CPU) 100 that controls operations of the game machine 10 on the basis of a program. Various signals are supplied to the CPU 100 from the buttons 20, 22, 24, and 26, the spin lever 30, and reel sensors 64A, 64B, and 64C.

Operations of the game machine 10 will be described briefly. Before starting operations, the reel unit motor 80 has pivoted the reel unit 14 to the first position and stopped the reel unit 14 at the first position, so that the peripheral surfaces 42A, 42B, and 42C of the reels 40A, 40B, and 40C have been observable by through the opening 32 of the housing 16 as shown in FIG. 1. A player can play a first game, i.e., a normal slot game using the visible peripheral surfaces 42A, 42B, and 42C of the plurality of reels 40A, 40B, and 40C. Once the player pushes the spin button 24 or turns the spin lever 30, a start signal is supplied from the spin button 24 or the spin lever 30 to the CPU 100. Then, the CPU 100 starts supplying drive-pulses to the reel motors 56A, 56B, and 56C for rotating the reel motors 56A, 56B, and 56C, and then stops the individual rotations of the reel motors 56A, 56B, and 56C at different random times. For example, the CPU 100 stops the left-end reel motor 56C first, the center reel motor 56B next, and then the right-end reel motor 56A.

Upon stopping all the reel motors 56A, 56B, and 56C, the CPU 100 estimates the rotational angle of each of the reels 40A, 40B, and 40C on the basis of signals received to the CPU from reel sensors 64A, 64B, and 64C and the number of pulses supplied to the respective reel motors from the CPU 100. For example, the CPU 100 estimates the rotational angle of the reel 40A on the basis of the number of pulses input to the reel motor 56A after the time of the last detection signal supplied from the reel sensor 64A that indicates the last detection of the segment 66A by the sensor 64A.

Next, the CPU 100 determines whether or not the combination of the symbols on the reels 40A, 40B, and 40C (i.e., the rotational angles of the reels 40A, 40B, and 40C) corresponds to any one of predetermined prize patterns including a special pattern. If the combination of the symbols does not coincide with any prize pattern, the player loses the game. If the combination of the symbols coincides with a prize pattern that is not the special pattern, the CPU 100 supplies a command to a payment device (not shown) for paying a prize amount corresponding to the prize pattern in coin, and stands ready to perform the normal slot game.

If the combination of the symbols coincides with the special pattern, the CPU 100 supplies a command to the reel unit motor 80 for pivoting the reel unit 14 by 90 degrees to the second position as shown in FIG. 4. In the second position, the first rotatable pointer 46A on the right lateral surface 44A of the right-end reel 40A and the first lateral symbols 74A on the right lateral wall 70A of the reel case 50 are observable by the player through the opening 32 of the housing 16. After the reel unit motor 80 stops the reel unit 14 at the second position, the player can play the second game using the visible right-end reel 40A having the first rotatable pointer 46A and the visible first lateral symbols 74A on the right lateral wall 70A of the reel case 50. Each of the first lateral symbols 74A represents a prize amount to be given to the player. Accordingly, the second game is a subsidiary game (prize-amount-determining game) for determining the prize amount that the player can acquire.

In the second game, once the player pushes the spin button 24 or turns the spin lever 30, a start signal is supplied from the spin button 24 or the spin lever 30 to the CPU 100. Then, the CPU 100 starts supplying drive-pulses to the right-end reel motor 66A for rotating the right-end reel motor 65A, and then stops the rotation of the reel motor 56A at a random time.

Upon stopping the reel motor 56A, the CPU 100 estimates the rotational angle of the right-end reel 40A on the basis of the number of pulses input to the corresponding reel motor 56A after the time of the last detection signal supplied from the corresponding reel sensor 64A that indicates the last detection of the segment 66A by the sensor 64A. The rotational angle of the right-end reel 40A signifies the angle of the first rotatable pointer 46A that has been stopped. Therefore, the CPU 100 determines the first lateral symbol 74A (indicating a prize amount) pointed by the first rotatable pointer 46A At this stage, by means of the first lateral symbol 74A pointed by the first rotatable pointer 46A, the player also knows the prize amount that the player can acquire.

The player can select to play the third game or to get the prize amount pointed by the first rotatable pointer 46A. If the player pushes the cash button 20 to get the prize amount, the CPU 100 supplies a command to the above-mentioned payment device (not shown) for paying the prize amount in coin, and supplies a command to the reel unit motor 80 for pivoting the reel unit 14 by 90 degrees to the first position for standing ready to perform the first game as shown in FIG. 4.

On the other hand, if the player pushes a button (not shown) to play the third game, the CPU 100 supplies a command to the reel unit motor 80 for pivoting the reel unit 14 by 180 degrees to the third position as shown in FIG. 5. In the third position, the second rotatable pointer 46C on the left lateral surface 44C of the left-end reel 40C and the second lateral symbols 74C on the second lateral wall 70C of the reel case 50 are observable by the player through the opening 32 of the housing 16. After the reel unit motor 80 stops the reel unit 14 at the third position, the player can play the third game using the left-end reel 40C having the second rotatable pointer 46C and the second lateral symbols 74C on the second lateral wall 70C of the reel case 50. Each of the second lateral symbols 74C represents a multiplier that should be multiplied to the prize amount to be given to the player. As a result of the third game, the player can obtain the product of the multiplier and the prize amount in coin. However, the symbol "LOSS" means that the player can obtain nothing. Accordingly, the third game is another subsidiary game (multiplier-determining game) for determining the multiplier that should be multiplied to the prize amount, and for determining the product (total amount) that the player can acquire.

In the third game, once the player pushes the spin button 24 or turns the spin lever 30, a start signal is supplied from the spin button 24 or the spin lever 30 to the CPU 100. Then, the CPU 100 starts supplying drive-pulses to the left-end reel motor 56C for rotating the left-end reel motor 56C, and then stops the rotation of the left-end reel motor 56C at a random time.

Upon stopping the reel motor 56C, the CPU 100 estimates the rotational angle of the left-end reel 40C on the basis of the number of pulses input to the corresponding reel motor 56C after the time of the last detection signal supplied from the corresponding reel sensor 64C that indicates the last detection of the segment 66C by the sensor 64C. The rotational angle of the left-end reel 40C signifies the angle of the second rotatable pointer 46C that has been stopped. Therefore, the CPU 100 determines the second lateral symbol 74C (indicating a multiplier) pointed by the second rotatable pointer 46C. At this stage, by means of the second lateral symbol 74C pointed by the second rotatable pointer 46C, the player also knows the multiplier.

The player can select to replay the third game or to get the total amount that is the product of the prize amount and the multiplier pointed by the second rotatable pointer 46C. If the player pushes the cash button 20 to get the total amount, the CPU 100 supplies a command to the above-mentioned payment device (not shown) for paying the total amount in coin, and supplies a command to the reel unit motor 80 for pivoting the reel unit 14 by 90 degrees to the first position for standing ready to perform the first game as shown in FIG. 1.

If the player pushes the spin button 24 or turns the spin lever 30 to replay the third game, a start signal is supplied to the CPU 100, again. Then, the CPU 100 starts supplying drive-pulses to the left-end reel motor 56C for rotating the left-end reel motor 56C, and then stops the rotation of the left-end reel motor 56C, again. The multiplier pointed by the second rotatable pointer 46C at this stage will be multiplied to the last total amount resulting from the last third game.

In the first embodiment, the first and second lateral symbols 74A and 74C can be printed or written on the right and left lateral walls 70A and 70C of the reel case 50. However, in a second embodiment, the first lateral symbols 74A and/or the second lateral symbols 74C are changeably displayed by electronic display devices. This feature will be descried next with reference to FIGS. 7 and 8.

Figure 7:
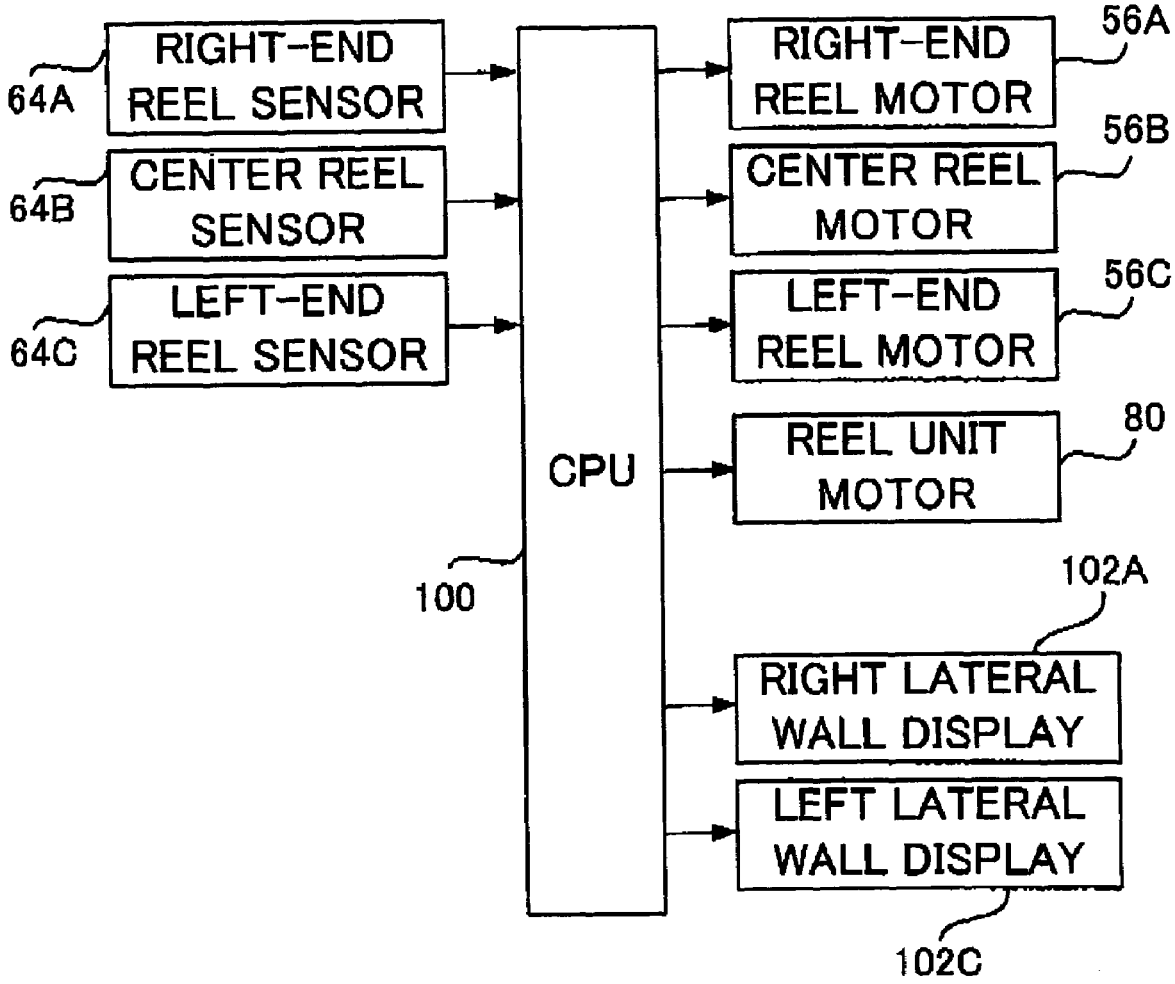
FIG. 7 is a block diagram of a game machine according to a second embodiment of the present invention.

FIG. 7 is a block diagram of another game machine according to the second embodiment of the present invention The second embodiment is based on the first embodiment, and the same reference symbols are used in FIG. 7 for identifying elements that are also used in the first embodiment.

As shown in FIG. 7, the game machine 10 includes a right lateral wall display 102A and a left lateral wall display 102C that are controlled by the CPU 100. The right lateral wall display 100A is partially embedded in the right lateral wall 70A of the reel case 50, so as to display the first lateral symbols 74A. The left lateral wall display 102C is partially embedded in the left lateral wall 70C of the reel case 50, so as to display the second lateral symbols 74C.

Each of the displays 102A and 102C may be a liquid crystal display, a plasma display, an organic electroluminescent display, a light emitting diode display, an electrophoresis display, or any another suitable electronic display device. The first lateral symbols 74A as a whole is displayed on the single right lateral wall display 102A in the second embodiment, but the first lateral symbols 74A may be individually displayed on a plurality of small display devices, respectively in an alternative embodiment that is not shown. The second lateral symbols 74C as a whole is displayed on the single left lateral wall display 102C in the second embodiment, but the second lateral symbols 74C may be individually displayed on a plurality of small display devices, respectively in an alternative embodiment that is not shown.

When the reel unit motor 80 pivots the reel unit 14 to the second position and stops the reel unit 14 at the second position, the CPU 100 turns on the right lateral wall display 102A, so as to show the first lateral symbols 74A as illustrated in FIG. 4. When the reel unit motor 80 pivots the reel unit 14 to the third position and stops the reel unit 14 at the third position, the CPU 100 turns on the left lateral wall display 102C, so as to show the second lateral symbols 74C as illustrated in FIG. 5.

By virtue of the lateral wall displays 102A and 102B each comprising one or more electronic display devices, a wide variety of symbols can be shown. For example, the lateral wall display 102A can show the first lateral symbols 74A illustrated in FIG. 8 in addition to those illustrated in FIG. 4.

Furthermore, the game machine according to the second embodiment can provide more kinds of games. When the reel unit motor 80 is pivoted to the first position as shown in FIG. 1, players can play a first game, i.e., a normal slot game using the peripheral surfaces 42A, 42B, and 42C of the plurality of reels 40A, 40B, and 40C. Thereafter, when the reel unit motor

Figure 8:
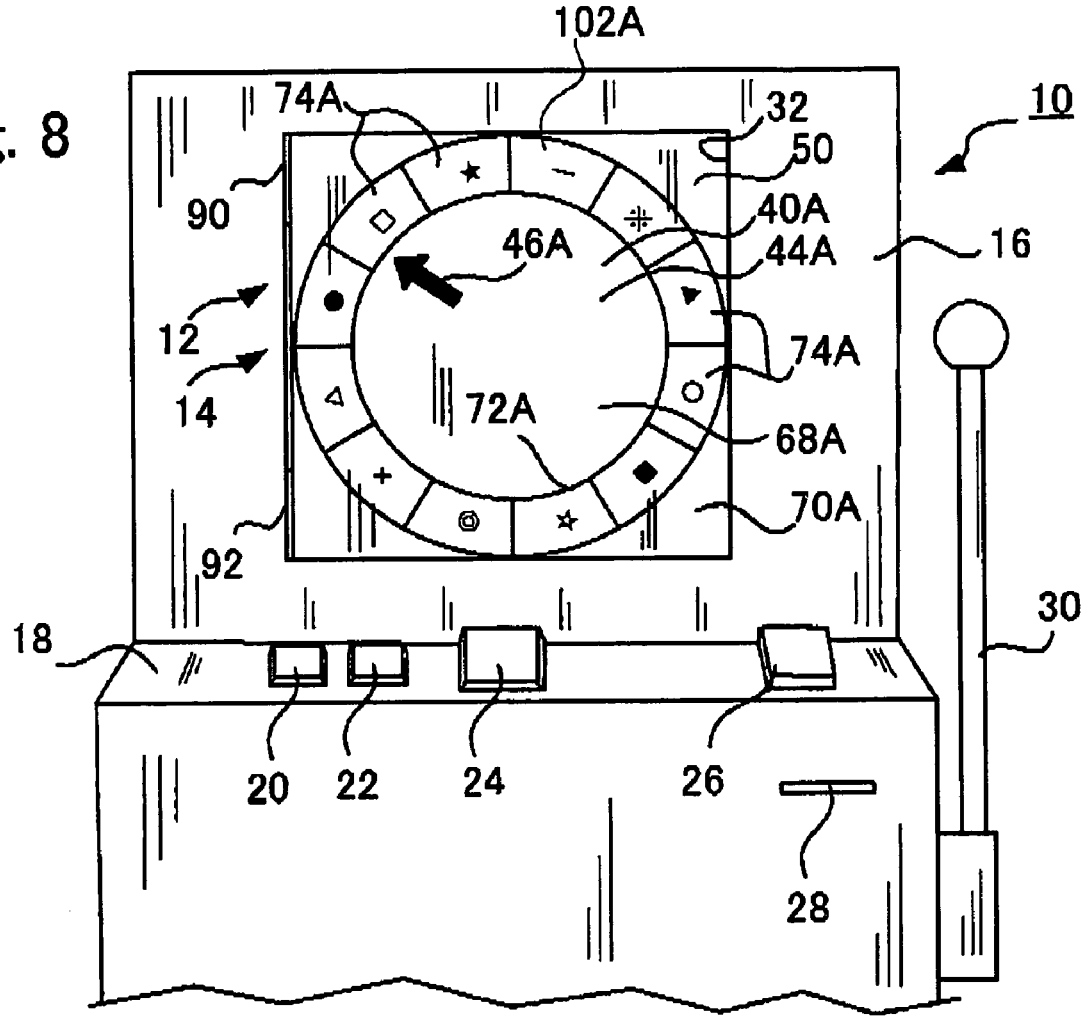
FIG. 8 is a front view of the game machine according to the second embodiment wherein the reel unit has been stopped at a second position.

80 is pivoted to the second position as shown in FIG. 4, players can play a second game using the right-end reel 40A having the first rotatable pointer 46A and the first lateral symbols 74A displayed by the right lateral wall display 102A Thereafter, when the reel unit motor 80 is pivoted to the third position as shown in FIG. 5, players can play a third game using the left-end reel 40C having the second rotatable pointer 46C and the second lateral symbols 74C displayed by the left lateral wall display 102C. Thereafter, when the reel unit motor 80 is pivoted to the second position again, the CPU 100 causes the right lateral wall display 102A to present another pattern of the first lateral symbols 74A as shown in FIG. 8 and players can play a fourth game using the right-end reel 40A having the first rotatable pointer 46A and the new first lateral symbols 74A. Thereafter, when the reel unit motor 80 is pivoted to the third position, the CPU 100 causes the left lateral wall display 102C to present another pattern of the second lateral symbols 74C and players can play a fifth game using the left-end reel 40C having the second rotatable pointer 46C and the new second lateral symbols 74C.

In the above described embodiments, the lateral symbols 74A and 74C are numerals and/or marks. However, another sorts of symbols including alphabetical or other letters or pictures may be used as the lateral symbols in an alternative embodiment that is not shown.

Figure 9:
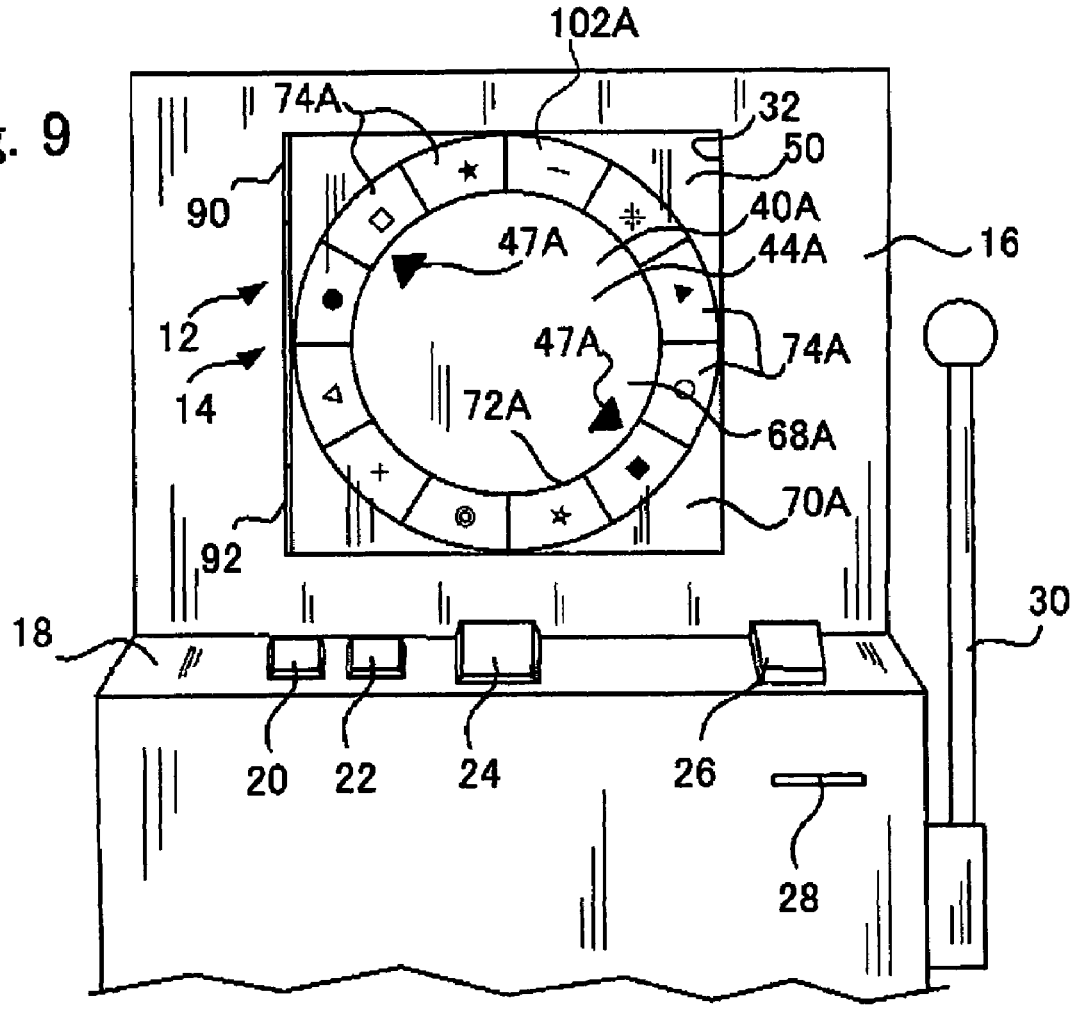
FIG. 9 is a front view of a game machine according to another embodiment wherein the reel unit has been stopped at a second position.

In the above-described embodiments, the right lateral surface 44A of the right-end reel 40A has the single first rotatable pointer 46A and the left lateral surface 44C of the left-end reel 40C has the single second rotatable pointer 46C. However, the right lateral surface 44A may have a plurality of first rotatable pointers 47A in an alternative embodiment as shown in FIG. 9. The left lateral surface 44C may have a plurality of second rotatable pointers in another alternative embodiment that is not shown. In these cases, more various kinds of games may be presented.

It will be appreciated that the present invention has been described by way of example only and with reference to the accompanying drawings, and that improvements and modifications may be made to the invention without departing from the scope or spirit thereof.

What is claimed is:

1. A symbol display device for a game machine, comprising:

a reel unit including:

a plurality of reels each having a rotational axis and aligned in manner that the rotational axes are coincident or substantially parallel, each of the reels having a peripheral surface where a plurality of peripheral symbols are displayed, the reels including an end reel arranged at an end position of the reels;

a reel supporting member that supports the reels rotatably independently, the reel supporting member including a lateral wall having a plurality of lateral symbols arranged around the rotational axis of the end reel;

a plurality of driving units that rotate the reels respectively; and a pointer that rotates about the rotational axis of the end reel due to rotation of the end reel, the pointer indicating one of the lateral symbols on the lateral wall of the reel supporting member when the end reel and the pointer stop rotating; and a pivoting unit that pivots the reel unit to a first position where the peripheral surfaces of the reels are observable and to a second position where the pointer and the lateral symbols on the lateral wall of the reel supporting member are observable.

2. The symbol display device according to claim 1, wherein the reels include a second end reel arranged at a second end position of the reels opposite to the end reel, the reel supporting member including a second lateral wall having a plurality of second lateral symbols arranged around the rotational axis of the second end reel, the reel unit including a second pointer that rotates about the rotational axis of the second end reel due to rotation of the second end reel, the second pointer indicating one of the second lateral symbols on the second lateral wall of the reel supporting member when the second end reel and the second pointer stop rotating, the pivoting unit further pivoting the reel unit to a third position where the second pointer and the second lateral symbols on the second lateral wall of the reel supporting member are observable.

3. The symbol display device according to claim 1, wherein the lateral symbols are changeably displayed by at least an electronic display device.

4. The symbol display device according to claim 2, wherein at least either of the lateral symbols and the second lateral symbols are changeably displayed by at least electronic display devices.

5. A game machine comprising the symbol display device according to claim 1.

6. The symbol display device according to claim 1, wherein the end reel has a lateral surface where the pointer is displayed, and wherein the lateral wall of the reel supporting member has a first window through which the lateral surface of the end reel is seen, the lateral symbols on the lateral wall of the reel supporting member being arranged around the outside of the first window.

7. The symbol display device according to claim 2, wherein the second end reel has a second lateral surface where the pointer is displayed, and wherein the second lateral wall of the reel supporting member has a second window through which the second lateral surface of the second end reel is seen, the second lateral symbols on the second lateral wall of the reel supporting member being arranged around the outside of the second window.

* * * * *